US008328701B2

(12) United States Patent
Dahary

(10) Patent No.: US 8,328,701 B2
(45) Date of Patent: Dec. 11, 2012

(54) EXERCISE PLATFORM

(76) Inventor: Doron Dahary, Ra'anana (IL)

( * ) Notice: Subject to any disclaimer, the term of this patent is extended or adjusted under 35 U.S.C. 154(b) by 0 days.

(21) Appl. No.: 12/671,551

(22) PCT Filed: Aug. 7, 2008

(86) PCT No.: PCT/IL2008/001092

§ 371 (c)(1),
(2), (4) Date: Mar. 15, 2010

(87) PCT Pub. No.: WO2009/019702

PCT Pub. Date: Feb. 12, 2009

(65) Prior Publication Data

US 2011/0143897 A1 Jun. 16, 2011

Related U.S. Application Data

(60) Provisional application No. 60/954,321, filed on Aug. 7, 2007.

(51) Int. Cl.
*A63B 21/00* (2006.01)

(52) U.S. Cl. ..... 482/130; 482/142; 482/907; 438/258

(58) Field of Classification Search ..... 482/142, 482/130, 907, 443; 438/258
See application file for complete search history.

(56) References Cited

U.S. PATENT DOCUMENTS

| | | | | |
|---|---|---|---|---|
| 4,065,124 | A | 12/1977 | Egan | |
| 6,634,999 | B2 | 10/2003 | Herbst | |
| 6,669,611 | B2 | 12/2003 | Raymond | |
| 6,740,008 | B1 | 5/2004 | Ho et al. | |
| 6,817,864 | B1 * | 11/2004 | Martinez | 434/258 |
| 2004/0220029 | A1 | 11/2004 | Chen | |
| 2004/0229738 | A1 | 11/2004 | Hobson | |
| 2005/0009677 | A1 | 1/2005 | Yang | |

* cited by examiner

*Primary Examiner* — Jerome w Donnelly
(74) *Attorney, Agent, or Firm* — Roach Brown McCarthy & Gruber, P.C.; Kevin D. McCarthy

(57) ABSTRACT

The invention is an inclined dome shaped exercise platform. The upper surface of the platform of the invention is large and shallow so that a user can comfortably lie on it. The dome is made of a stiff material and it is preferably covered with a layer of foam, which is in turn covered with decorative upholstery material. Embodiments of the platform of the invention include grasping means to assist in performing the exercises.

8 Claims, 11 Drawing Sheets

EXERCISE PLATFORM

REFERENCE TO CO-PENDING APPLICATIONS

Priority is claimed from a 371 of international of PCT/IL2008/001092, filed on Aug. 7, 2008, which claims priority to U.S. provisional patent application Ser. No. 60/954,321, filed on Aug. 7, 2007.

FIELD OF THE INVENTION

The invention is related to the field of personal exercise devices. Specifically the invention relates to passive devices that can be used by individuals to aid them in carrying out a variety of exercises.

BACKGROUND OF THE INVENTION

Today, in industrialized countries, many people sit for long periods of time. They sit while eating, while going to work in cars or buses, in school classrooms, in meetings, in offices, and at home while watching television. Many people also sit at work operating machines which new technology has developed to replace manual work. Although sitting requires less physical effort than standing or walking, sitting puts a lot of stress on lumbar vertebrae and on various muscles of the lower and upper torso and the neck. The combined effects of a sedentary lifestyle and a job that requires sitting can lead to many health problems.

The source of many of these problems is uneven distribution of weight on the disks between the lumbar vertebrae while the individual is sitting. FIG. 1*a* shows a man standing. The lumbar portion 21 of the spinal column in the standing posture is shown in expanded view in FIG. 1*c*. As seen in FIG. 1*a*, the natural position of lumbar portion 21 is concave outward. This produces an even distribution of weight on disks 24, as can be seen in FIG. 1*c*. In the standing position the muscles of the back and abdomen support the spinal column.

On the other hand, as is illustrated in FIG. 1*b*, when sitting the lumbar portion 21 is pressed into a concave inward posture. In the concave inward posture, pressure is unevenly distributed in lumbar vertebrae 22, which results in an outward pressure on disks 24 as illustrated by arrows 52 in expanded view FIG. 1*d* of lumbar portion 21 in the sitting posture. This outward pressure produces back pain and can lead to slipped disks and other health problems.

Many of the health problems related to a sedentary lifestyle can be alleviated by proper stretching, exercise, and fitness routines and by improved posture when resting. The exercises should be challenging enough to improve ones fitness, but not endanger the health or well being of the exerciser. In many forms of exercise the exerciser runs a high risk of injury through accidents or through overuse of certain joints. For example joggers and bicyclist run a risk of traffic accidents and the constant pounding of jogging may injure the feet or knees of the jogger.

Therefore there is a demand for exercise equipment that is safe and comfortable and promotes effective strengthening and stretching of the lumbar area. Many devices are available for facilitating exercises, for physical therapy or for physical training. Mats of various forms exist for therapeutic exercises or to improve safety and comfort or adjust the difficulty of conventional exercises (such as sit-ups and push-ups).

Athletes have long used exercise horses, the Swiss ball and similar spherical or semi-spherical exercise devices such as described in US2004/0220029 and US2005/0009677 for developing balance. Some exercisers have found that the dome shape of the Swiss ball facilitates sit-ups and back stretching exercises as illustrated in US2004/0220029. Nevertheless the Swiss ball and exercise devices based on it do not support the entire body of a exerciser. Thus lying on a Swiss ball or an exercise horse requires good balance and strong muscles. Therefore its use is beyond the ability of most exercisers. Such devices are not well suited to the average office worker and particularly not to workers who are overweight or have injuries to their backs or necks.

Thus, there is a need for a device that facilitates muscle toning exercises and therapeutic routines for gently comfortably stretching and strengthening muscles, tendons and joints and particularly the lumbar area that is affected by constant sitting. The device should also be useful to promote proper stretching of the lumbar area and torso while resting and should be easy and comfortable to be used by office workers and others in various states of health and fitness.

It is therefore a purpose of the present invention to provide an exercise device that is safe and comfortable and promotes effective strengthening and stretching of the lumbar area.

It is another purpose of the present invention to provide an exercise device that facilitates muscle toning exercises and therapeutic routines for gently comfortably stretching and strengthening muscles, tendons and joints, particularly in the lumbar area.

It is another purpose of the present invention to provide an exercise device that promotes proper stretching of lumbar area and torso while resting.

It is another purpose of the present invention to provide an exercise device that can be easily and comfortably used by individuals in various states of health and fitness.

Further purposes and advantages of this invention will appear as the description proceeds.

SUMMARY OF THE INVENTION

The invention is a platform for performing exercises by a user. The exercise platform of the invention comprises a dome shaped rigid surface mounted on an inclined base. The exercises are performed upon the dome shaped surface.

The inclined base can comprise either a wedge shaped base or a plurality of legs having different lengths. In embodiments of the invention, the incline angle of the base is adjustable by the user.

In embodiments of the platform of the invention the diameter of the dome shaped surface is preferably at least as large as a height of the user and the height of the dome shaped surface is less than ⅕ its diameter.

Embodiments of the platform of the invention may comprise straps, handles, or equivalent grasping means to help the user perform various exercises.

In preferred embodiments of the exercise platform a layer of foam covers the dome shaped rigid surface and a covering of decorative upholstery material covers the foam layer.

All the above and other characteristics and advantages of the invention will be further understood through the following illustrative and non-limitative description of preferred embodiments thereof, with reference to the appended drawings; wherein like components are designated by the same reference numerals.

DETAILED DESCRIPTION OF PREFERRED EMBODIMENTS

The present invention is an inclined exercise platform having a low pitched shallow dome shaped upper surface, referred to herein as a "dome". The dome of the invention is large and shallow so that a user can comfortably lie on it. The dome is made of a rigid material and it is preferably covered with a layer of foam, which is in turn covered with decorative upholstery material. Embodiments of the exercise platform of the invention include straps to assist in performing the exercises.

Figure 1D:
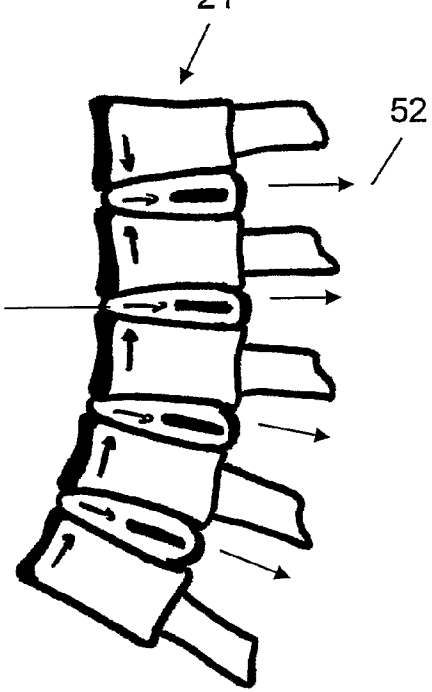
FIG. 1*d* is a schematic expanded view showing the lumbar portion of the spinal column in the sitting posture.
Figure 1C:
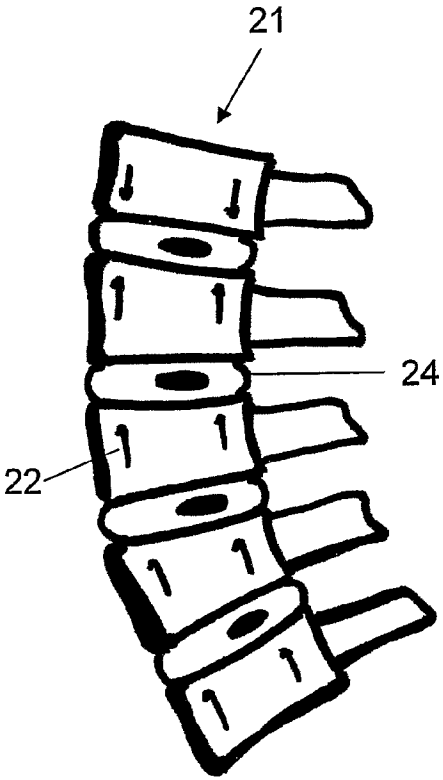
FIG. 1*c* is a schematic expanded view showing the lumbar portion of the spinal column in the standing posture.
Figure 1B:
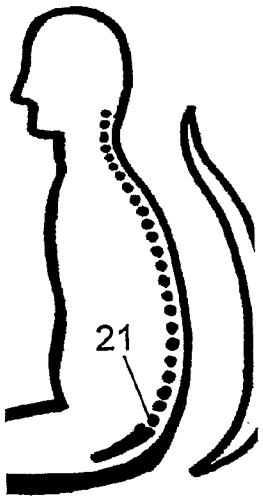
FIG. 1*b* is a schematic view showing a person sitting.
Figure 1A:
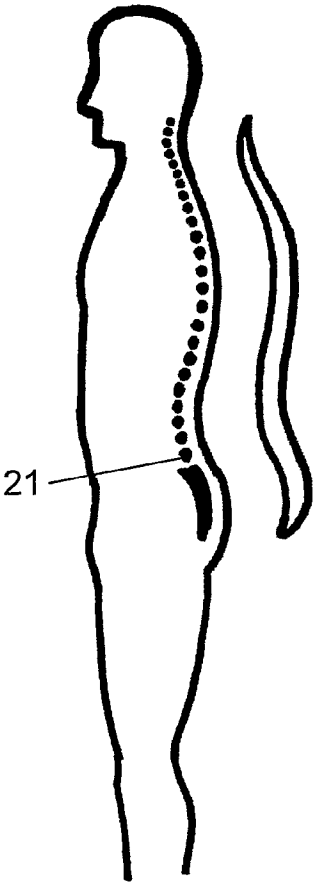
FIG. 1*a* is a schematic view showing a person standing.
Figure 2B:
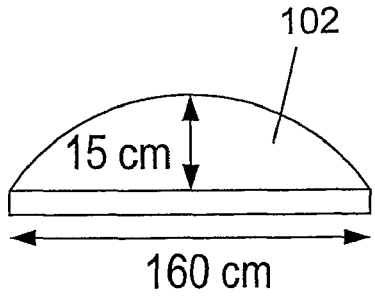
FIG. 2*a* and FIG. 2*b* show respectively a top view and side view of an embodiment of the dome shaped surface of an exercise dome according to the current invention
Figure 2A:
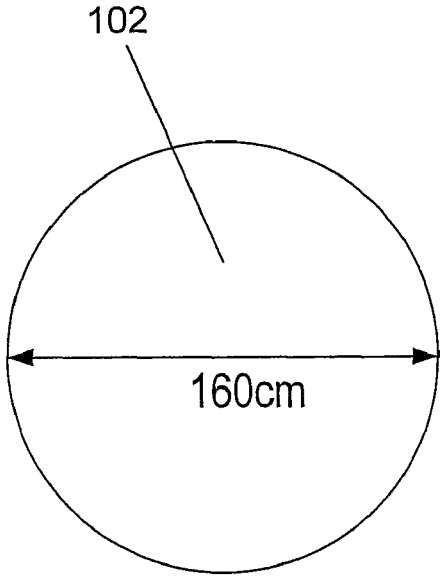
Figure 2C:
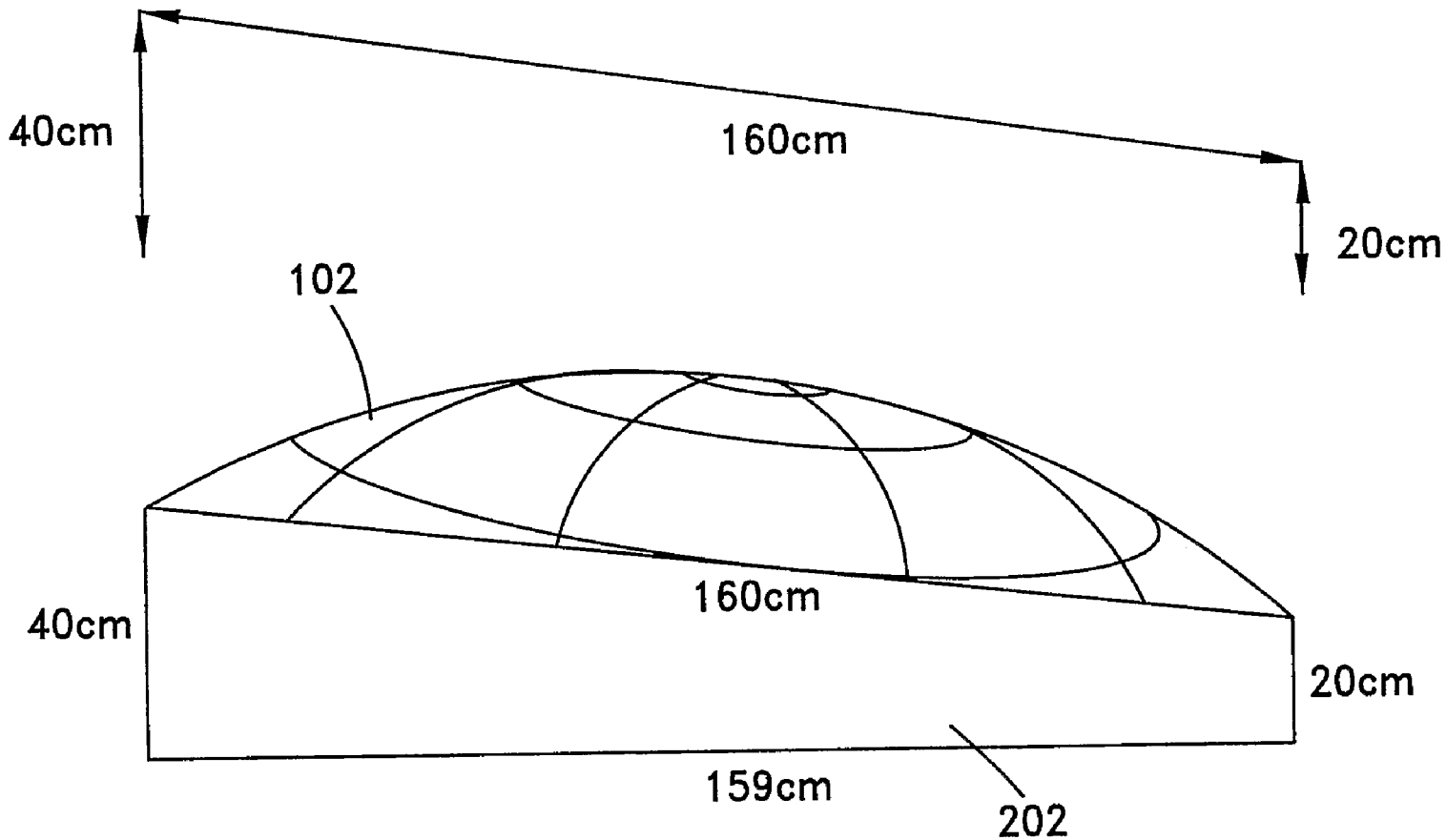
FIG. 2*c* shows a side view of the wedge shaped base on which the exercise dome of the invention is mounted.
Figure 4:
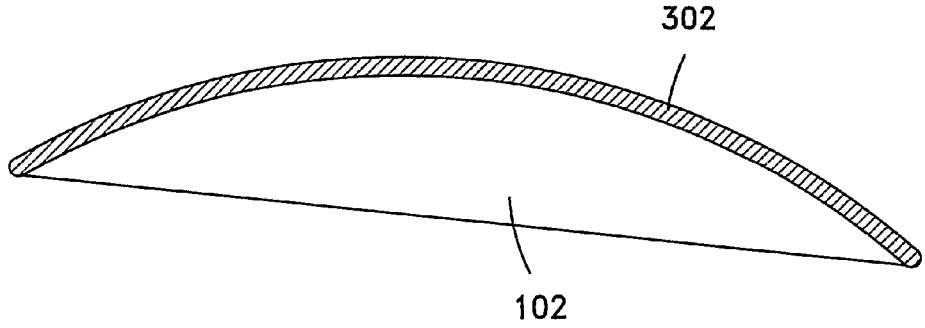
FIG. 4 shows a segment of an exercise dome of the invention covered by a thick layer of foam.

FIG. 2*a* and FIG. 2*b* show respectively a top view and side view of an embodiment of the dome shaped surface of an exercise platform according to the current invention. In a typical embodiment designed to be suitable for the dimensions of an adult the dome of the current invention comprises a rigid shallow dome 102 having a diameter of 160 cm and a height of 15 cm. Dome 102 is mounted on a wedge shaped base 202 as shown in FIG. 2*c*. In the embodiment shown, the height of the short side of base 202 is 20 cm while the height of the tall side is 40 cm. The wedge shaped base holds dome 102 on a mild incline of 12%. The incline optimizes stability and comfort for the user. The incline also optimizes the difficulty level of certain exercises, e.g. like sit-ups. The incline also allows the exerciser to choose the head up or head down position as illustrated in FIG. 4 and in FIG. 5. In an alternative embodiment, the incline angle of base 202 is adjustable by the user.

Figure 3A:
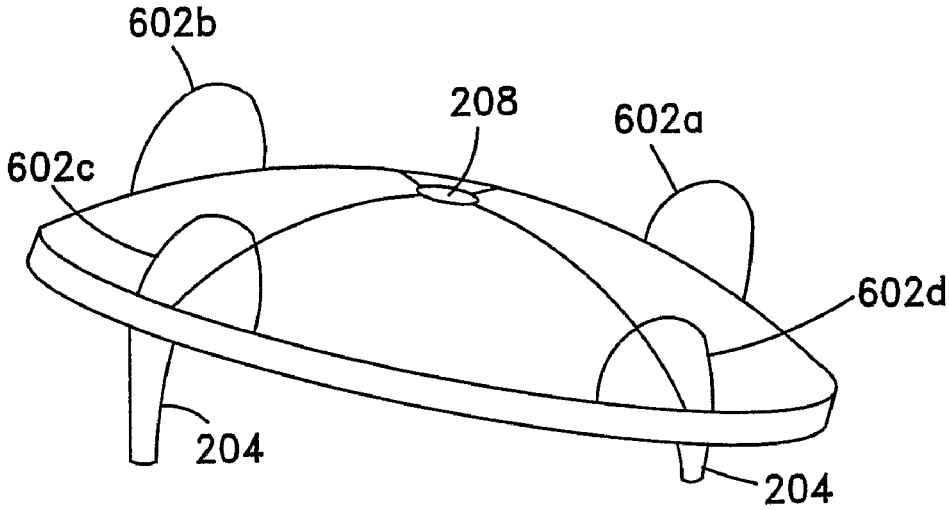
FIG. 3*a*, FIG. 3*b*, and FIG. 3*c* show an alternative embodiment of the invention in which the exercise dome stands on legs that are attached to it.
Figure 3B:
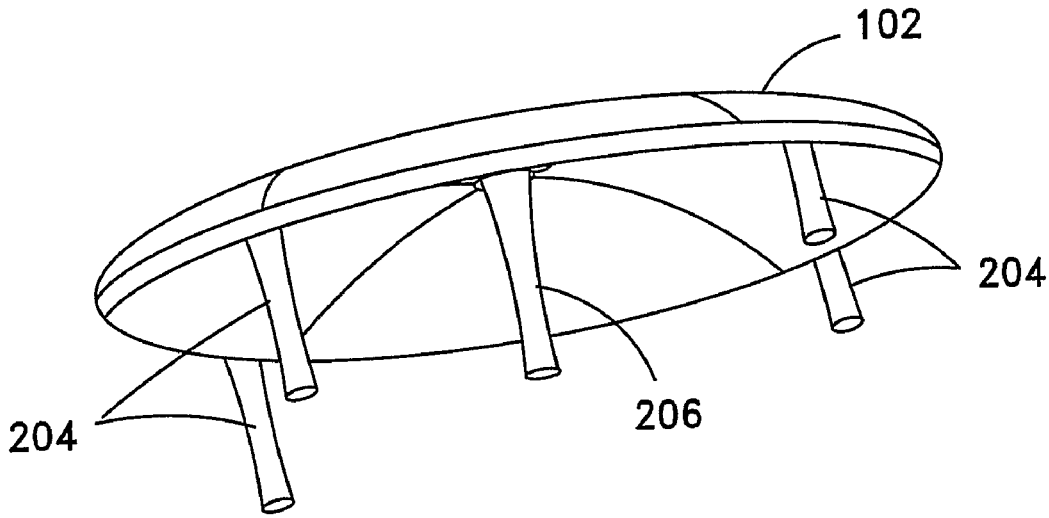
Figure 3C:
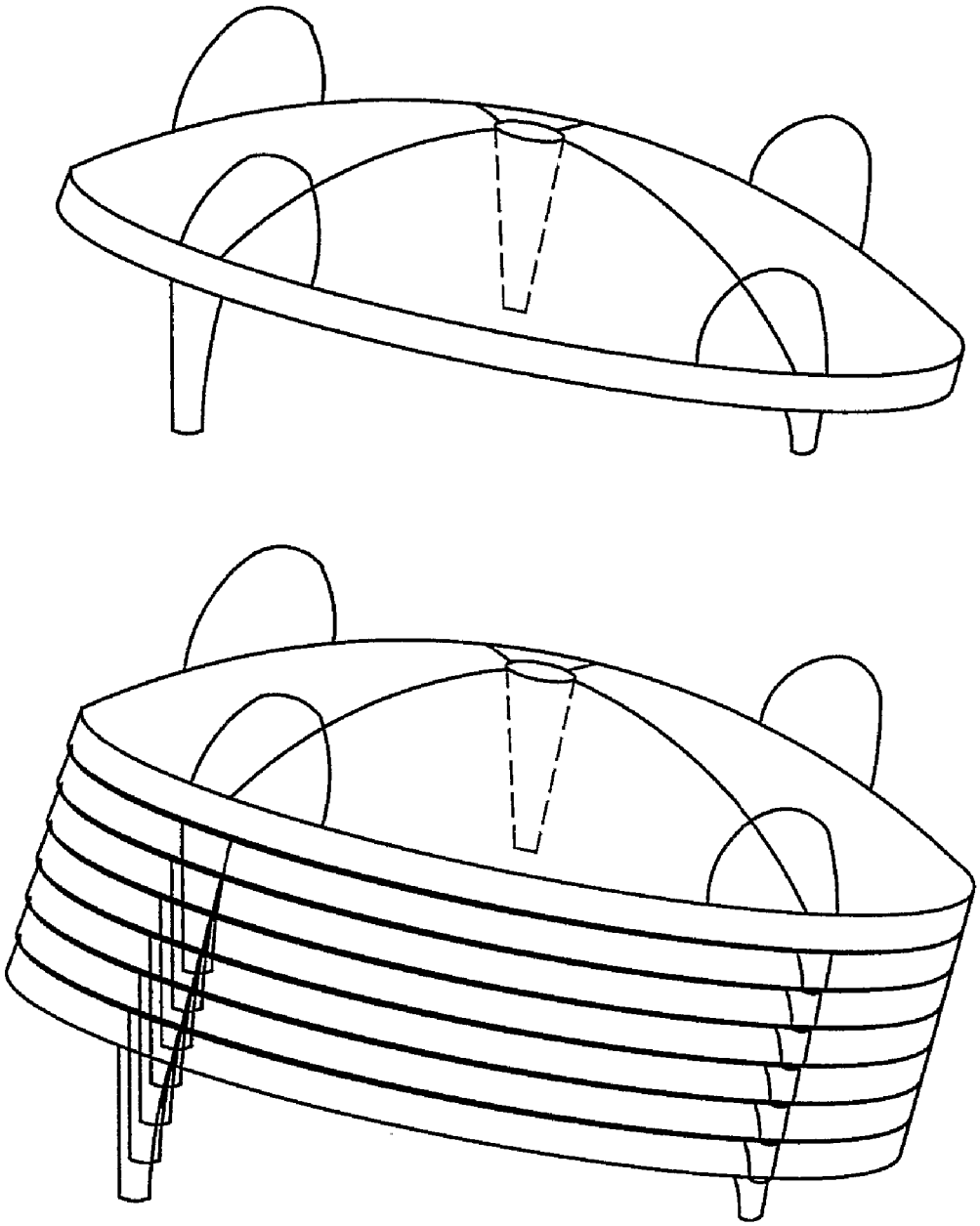

In an alternative embodiment shown in FIG. 3*a*, FIG. 3*b*, and FIG. 3*c* exercise dome 102 stands on legs that are attached to it. Peripheral legs 204 have different lengths around the circumference of the dome in order to achieve the proper incline. In a preferred embodiment, peripheral legs 204 are blade like. They slant slightly outwards and cross-sections of the legs in horizontal planes are arc-shaped. The interior leg 206 (or legs) is a round tapered pipe having a hollow interior as can be seen in the figures. In addition a hole 208 is created through the dome 102 in alignment with the hollow center of each interior leg. This design of the legs allows the interior leg of a first exercise platform to be inserted through hole 208 of a second platform and into the hollow interiors of the interior leg of the second platform. At the same time as leg 206 of the first platform slides into leg 206 of the second platform the peripheral legs 204 of the first platform will slide past those of the second platform in the same manner as the legs of plastic stackable garden chairs. In this manner the exercise domes 102 can be stacked when not in use as shown in FIG. 3*c*. This has obvious advantages for health clubs and other places in which exercise classes are held.

Dome 102 of the invention is made of a rigid material such as aluminum or steel or hard plastic. It can be manufactured, using standard techniques appropriate to the type of material chosen, as a single piece or in two or more sections that are fastened together to form the entire dome. It is noted that herein the word "rigid" when used to describe dome 102 means that the shape of the dome will not be deformed under any circumstances by the weight of the person that exercises on it.

FIG. 4 shows a segment of dome 102 and a thick layer of foam (or another type of material having foam like properties) 302, which covers the entire upper surface of the rigid dome to create a firm and comfortable platform on which a user can perform exercises. In a typical embodiment the layer of foam 302 is 10 cm thick and has a density of 38 kg/m$^3$. Foam 302 is then covered with decorative upholstery material according to the taste of the user and the planned use of the exercise dome, e.g. a commercial version might be covered with vinyl while a home version might be covered with cloth.

It will be understood to one skilled in the art, that the dome 102 may be circular in shape or may be oval or take another shape. The apex of dome 102 may be in the center of dome 102 as illustrated in the drawings or may be off-center. It is emphasized that the dimensions of the exercise dome are not critical to the concept of the invention and many variations are possible and in fact will be recommended for different individuals. For example the dome of an exercise platform for children would be smaller and an exercise platform for more advanced exercise would be higher and steeper. As a rule of thumb for most users, the diameter of the dome should be at least as large as the height of the user and the height of the dome should be no more than ⅕ of its diameter. The dimensions and other parameters of the dome and other features of the invention, e.g. number and location of legs and thickness and density of the foam covering, that are described herein and shown in the figures are provided only in order to illustrate the invention and are not to be construed as limiting the invention in any way.

Figure 5:
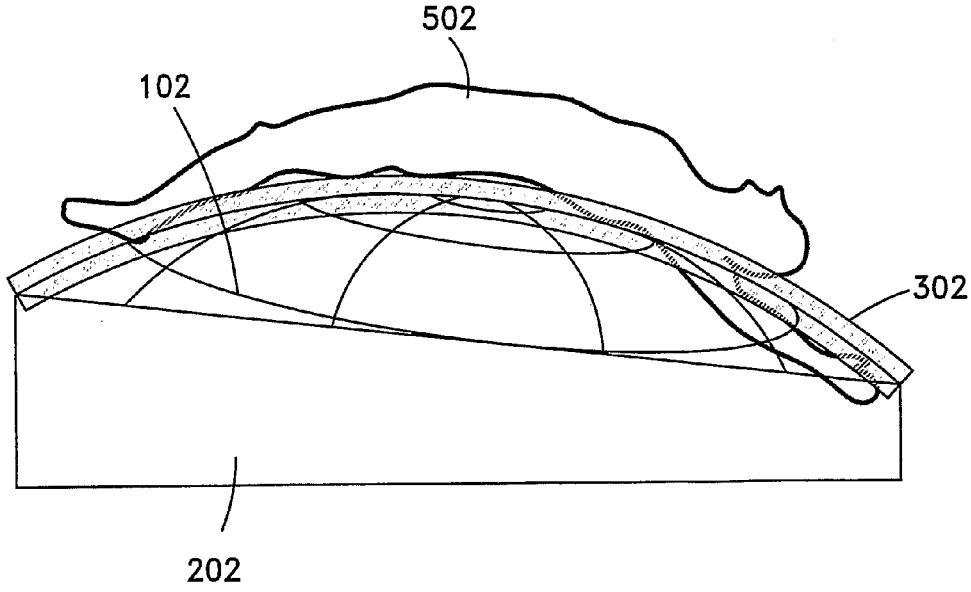
FIG. 5 illustrates a user lying head down on the exercise dome.
Figure 6:
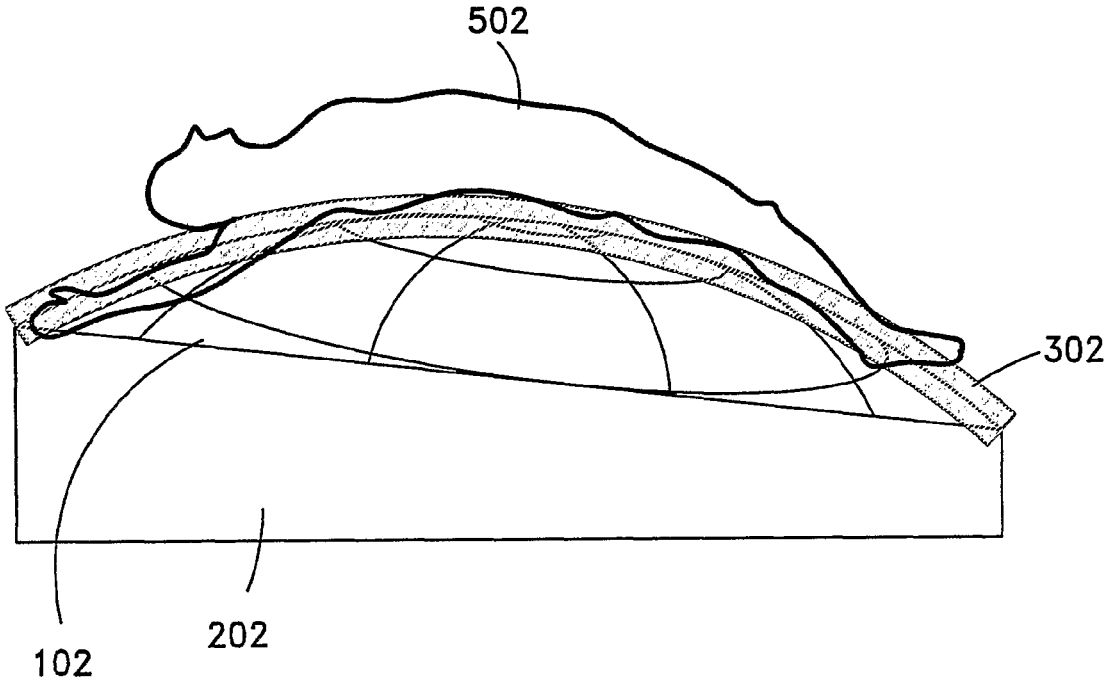
FIG. 6 illustrates a user lying head up on the exercise dome.
Figure 7:
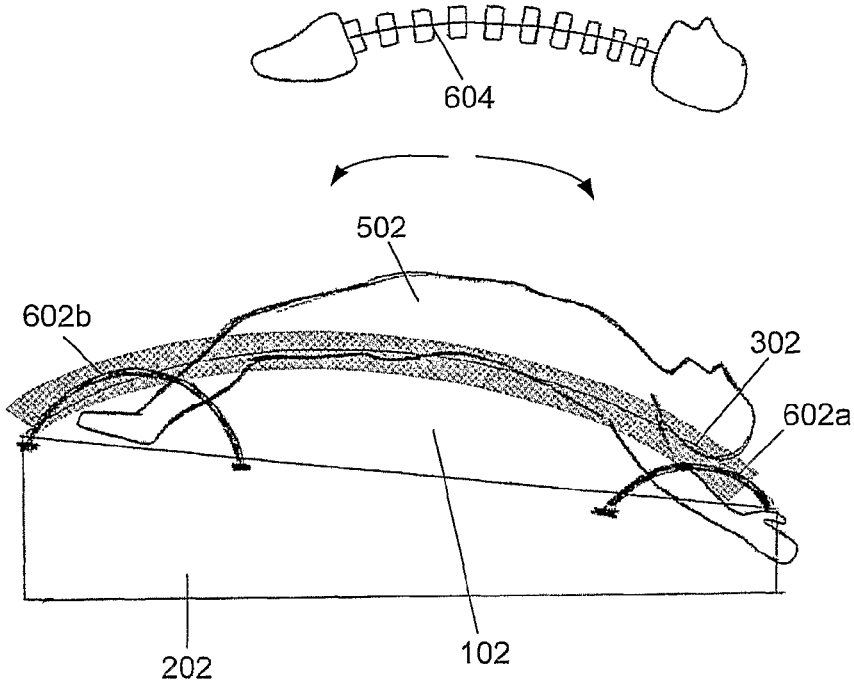
FIG. 7 illustrates use of the exercise dome for traction.

The exercise dome is very comfortable to lie on as illustrated in FIG. 5 and FIG. 6. As shown in FIG. 7 the domed surface gently reverses the compressed concave inward curvature produced in the lumbar vertebrae by too much sitting. This has a therapeutic affect on sore stomach muscles, leg cramps and backaches. A user 502 may lie in a head down position as illustrated in FIG. 5 or a head up position as illustrated in FIG. 6. Because of the comfortable gentle curvature and upholstery of the exercise dome, a user may lie in this therapeutic position for a long time.

Referring now to FIG. 7, straps 602*a* and 602*b* are connected to the perimeter of the exercise dome. A user lying on his back on the dome hooks his hands and legs through straps 602*a* and 602*b* respectively to create traction and stretch his back 604. In different embodiments the straps may be replaced by rigid handles. Handles, straps, or equivalent grasping means of different sizes and types may be supplied with the exercise platform. The grasping means may be permanently attached to the exercise platform or means may be provided to interchangeably attach them depending on the type of exercise or preference of the user.

A small sample of examples of some of the many different types of exercise can be performed with the aid of the exercise dome of the invention are shown in FIG. 8 to FIG. 12. It is noted that although the description and examples herein relate only to exercises to relieve problems in the lumbar region, it should be obvious that exercises that would be beneficial to many other regions of the body can also be performed on the exercise platform of the invention.

Figure 8:
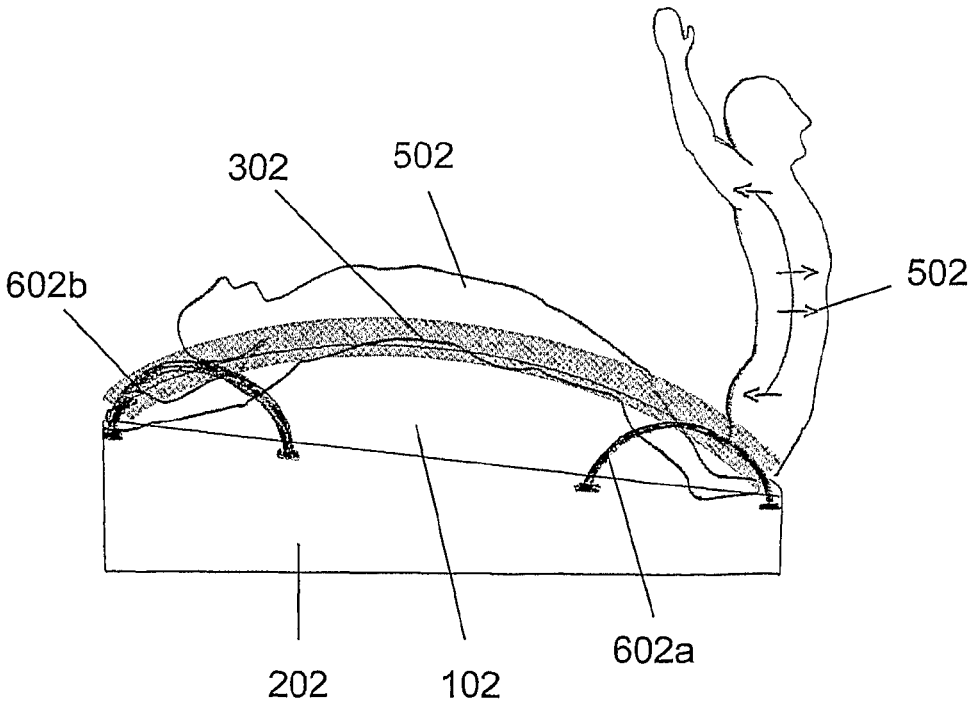
FIG. 8 illustrates use of the exercise dome for performing a torso extension.

FIG. 8 illustrates user 502 performing a torso extension to strengthen stomach and back muscles. Torso extensions and sit-ups can be performed in the head up position (as illustrated) or the head down position.

Figure 9:
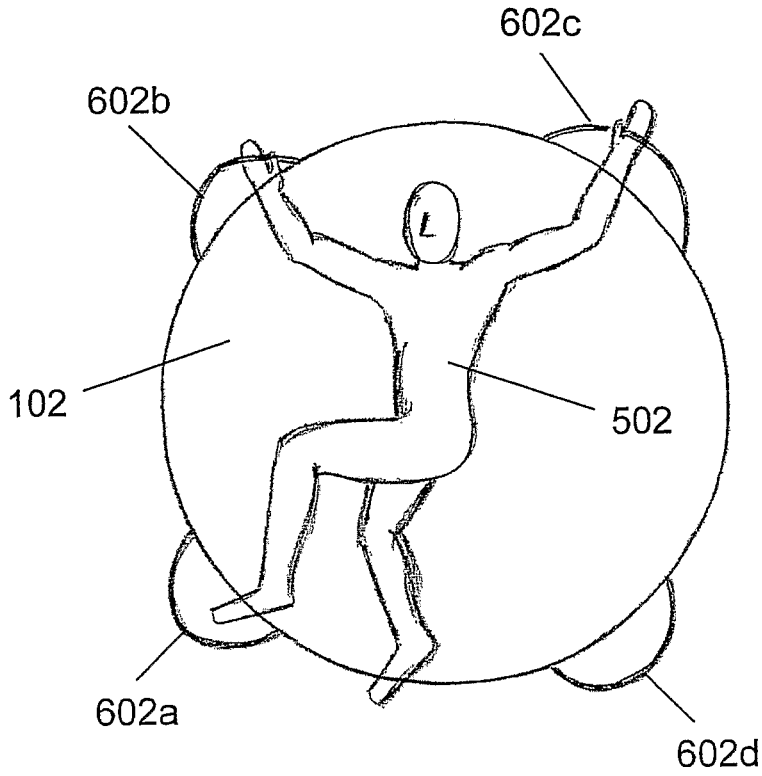
FIG. 9 illustrates use of the exercise dome for performing a half side flextion.

FIG. 9 is a view from above the exercise dome showing the position of straps 602*a-d*. In FIG. 9 user 502 is shown performing a half side flextion exercise, which includes stretching and rotating the back.

Figure 10:
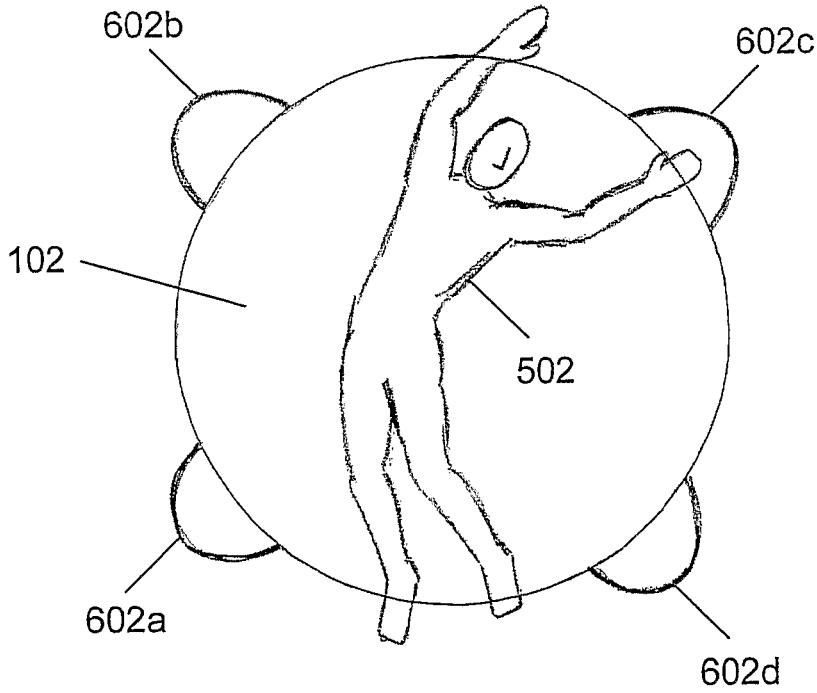
FIG. 10 illustrates use of the exercise dome for performing a full side flextion.

In FIG. 10, user 502 is shown performing a stretching and twisting full side flextion exercise. Flextion exercises help strengthen muscles of the torso and particularly, stretching and rotating the back while the lumbar portion is held in a concave outward position helps the lumbar vertebrae and disks realign themselves after a long day of sitting.

Figure 11:
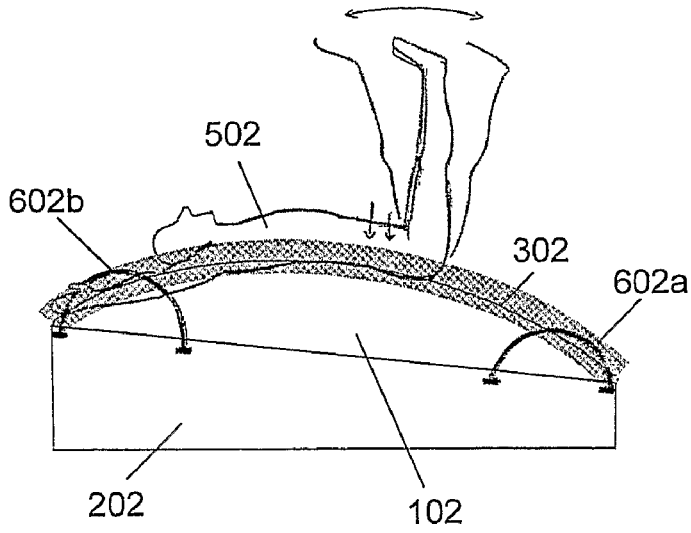
FIG. 11 illustrates use of the exercise dome for performing abdominal strengthening exercises.

In FIG. 11, user 502 is shown performing abdominal strengthening exercise. Note that for greater challenge this exercise can also be done in the head down position. Twisting sideways and revolving the feet and legs stretches the lumbar portion of his spinal column and helps the disks and vertebrae realign from the compression caused by sitting.

Figure 12:
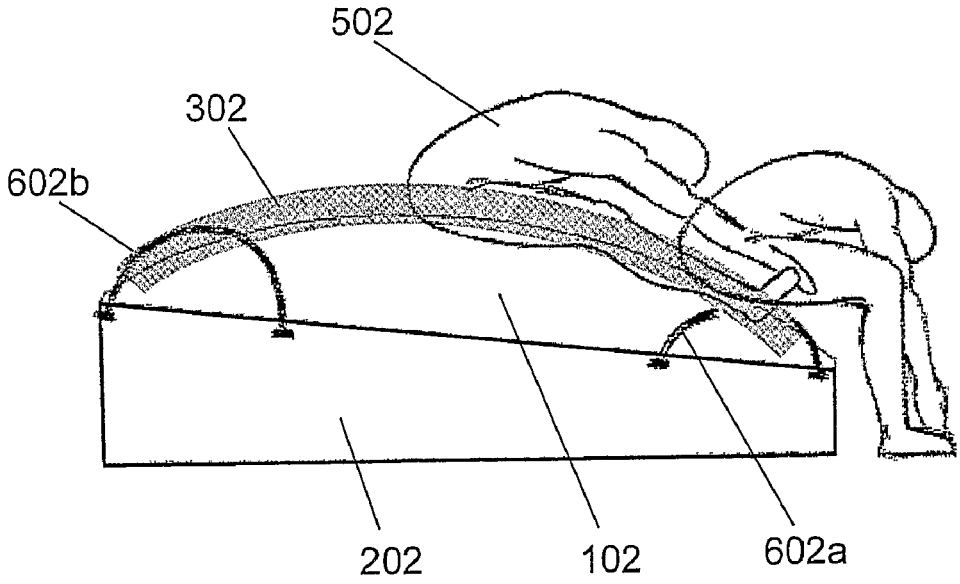
FIG. 12 illustrates use of the exercise dome for performing stretching exercises of the spine and hamstrings.

In FIG. 12, user 502 is shown performing a stretching exercise of the spine and hamstrings by a sliding and sitting motion. Note that for greater challenge this exercise can also be done in the head down position.

Figure 13:
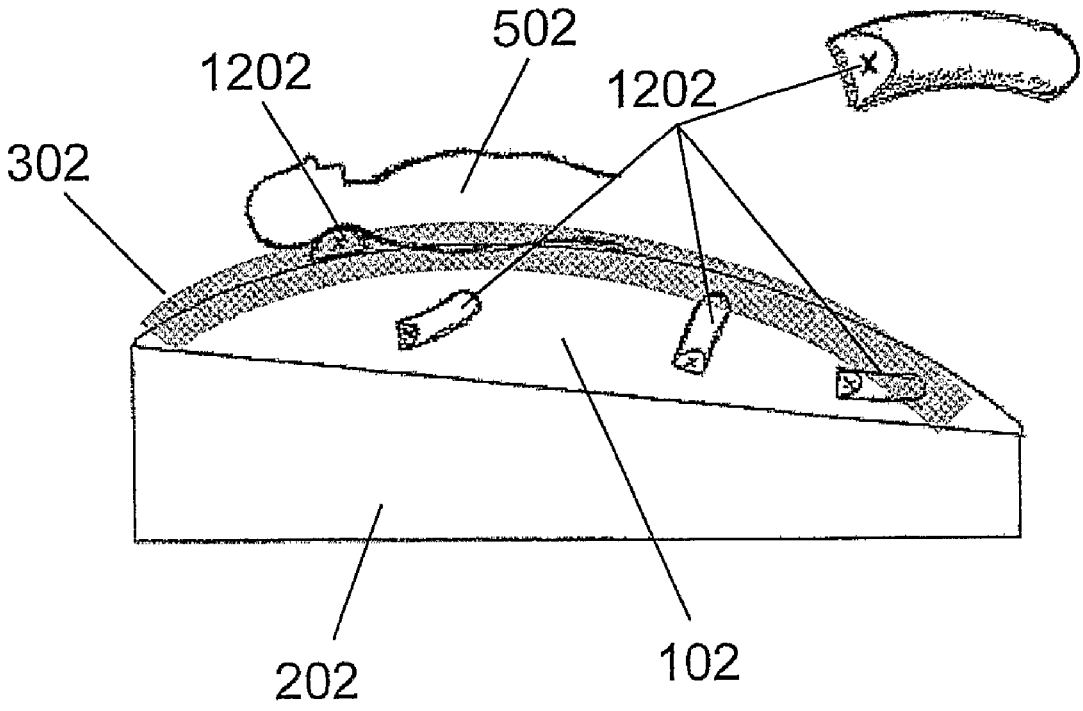
FIG. 13 illustrates the use of an optional pillow according to the present invention.

In FIG. 13 there is illustrated a small number of the possible locations at which an optional pillow 1202 may be placed on the exercise dome to give additional support to specific regions of the body while exercising. In order to prevent the pillows from moving during exercising, in an embodiment of the invention the foam layer is covered with the loop side of Velcro® material and the cushions are covered with the hook side of Velcro® material.

Although embodiments of the invention have been described by way of illustration, it will be understood that the invention may be carried out with many variations, modifications, and adaptations, without exceeding the scope of the claims.

The invention claimed is:

1. An exercise platform comprising (A) a rigid, low pitched shallow dome shaped upper surface having a concave side and a convex side;

(B) the convex side is adapted to allow a person to lay thereon to perform exercises;

(C) portions of the concave side attaches to an inclined base;

said inclined base holds said dome shaped upper surface on a mild incline, said base is i) a wedge shaped base; or ii) (a) a plurality of peripheral legs (i) having different lengths rigidly attached to the edge of said concave side at a plurality of locations around the circumference, (ii) each peripheral leg's proximal end extends from the concave side's edge, and (iii) each peripheral leg's distal end is capable of contacting a level floor surface at the same time as the remaining peripheral legs' distal ends, in order to achieve the desired incline and (b) an interior leg (i) rigidly attached to the interior surface of the rigid, low pitched shallow dome shaped upper surface, (ii) the interior leg's proximal end extends from the rigid, low pitched shallow dome shaped upper surface's interior surface and (iii) the interior leg's distal end is capable of contacting the level floor surface at the same time as the plurality of peripheral legs' distal ends.

2. The platform of claim 1, wherein the incline angle of the inclined base is adjustable by the user.

3. The platform of claim 1, wherein the diameter of the dome shaped upper surface is at least as large as a height of the user.

4. The platform of claim 1, wherein the height of the dome shaped upper surface is less than ⅕ of its diameter.

5. The platform of claim 1, further comprising straps or handles.

6. The platform of claim 1, further comprising a layer of foam covering said rigid dome shaped surface.

7. The platform of claim 6, further comprising a covering of decorative upholstery material over the layer of foam.

8. The platform of claim 1, wherein the interior leg is hollow and forms an aperture on the convex side so the aperture is capable to receive a second exercise platform's interior leg when the second exercise platform is stacked on the exercise platform.

* * * * *